US007896755B2

(12) United States Patent
Eddy

(10) Patent No.: US 7,896,755 B2
(45) Date of Patent: Mar. 1, 2011

(54) DEVICE FOR SWING TRAINING

(75) Inventor: William Michael Eddy, Guntersville, AL (US)

(73) Assignee: William Michael Eddy, Cullman, AL (US)

( * ) Notice: Subject to any disclaimer, the term of this patent is extended or adjusted under 35 U.S.C. 154(b) by 0 days.

(21) Appl. No.: 12/619,359

(22) Filed: Nov. 16, 2009

(65) Prior Publication Data

US 2010/0124997 A1 May 20, 2010

Related U.S. Application Data

(60) Provisional application No. 61/116,044, filed on Nov. 19, 2008.

(51) Int. Cl.
*A63B 69/36* (2006.01)
*A63B 23/14* (2006.01)

(52) U.S. Cl. ..... 473/257; 482/44; 473/219

(58) Field of Classification Search ..... 482/44–50, 482/106–108, 114, 115, 139, 188; 473/219, 473/223, 226, 229, 231, 257, 258, 294, 295, 473/296, 409

See application file for complete search history.

(56) References Cited

U.S. PATENT DOCUMENTS 4,557,479 A * 12/1985 Guibert ..... 482/110
5,167,596 A * 12/1992 Ferber ..... 482/46
5,820,521 A * 10/1998 Edwards et al. ..... 482/44
5,941,799 A * 8/1999 Bergdorf ..... 482/44
6,406,406 B1 * 6/2002 Onorati ..... 482/44
7,674,185 B2 * 3/2010 Omidi ..... 473/219

* cited by examiner

*Primary Examiner*—Nini Legesse

(57) ABSTRACT

Herein is described a swing training device comprising two handles, each handle with a threaded post, a male manufactured head with a male locking device and a threaded receptacle for the threaded post and a female manufactured head with a female locking device and a threaded receptacle for the threaded post, wherein one handle is connected to each manufactured head by screwing the threaded post into the threaded receptacle, and wherein the male locking device is releasably connected to the female locking device thereby forming the swing training device. The device can be used for general fitness training or to improve a user's golf skills while at the same time exercising, gaining strength and flexibility.

8 Claims, 4 Drawing Sheets

DEVICE FOR SWING TRAINING

RELATED APPLICATIONS

The present application claims benefit of priority from U.S. Provisional Application No. 61/116,044 filed Nov. 19, 2008, which is incorporated herein by reference in its entirety.

BACKGROUND OF THE INVENTION

The present invention generally relates to a training device to improve a player's swing such as a golf swing. Golf teachers and instructors around the world have a difficult time transferring to students the correct feel of the golf swing.

As can be seen, there is a need for a training device to give any, but mainly the amateur or beginning golfer, the true feel of a golf swing from start to finish.

SUMMARY OF THE INVENTION

In one aspect of the present invention a swing training device includes: two handles, each handle with a threaded post, a male manufactured head with a male locking device and a threaded receptacle for the threaded post, and a female manufactured head with a female locking device and a threaded receptacle for the threaded post, wherein one handle is connected to each manufactured head by screwing the threaded post into the threaded receptacle, and wherein the male locking device is releasably connected to the female locking device thereby forming the swing training device.

In another aspect of the present invention, a method of improving a user's golf skills while at the same time exercising, gaining strength and flexibility comprises: providing a swing training device as described herein; providing a training mat; providing instructions for exercises using the swing training device and the training mat, thereby allowing a user to improve golf skills while at the same time exercising, gaining strength and flexibility.

In another aspect of the present invention, a method of general fitness training comprises providing a swing training device as described herein and providing instructions for exercises using the swing training device, whereby a user can perform general fitness training.

These and other features, aspects and advantages of the present invention will become better understood with reference to the following drawings, description and claims.

DETAILED DESCRIPTION OF THE INVENTION

Figure 1:
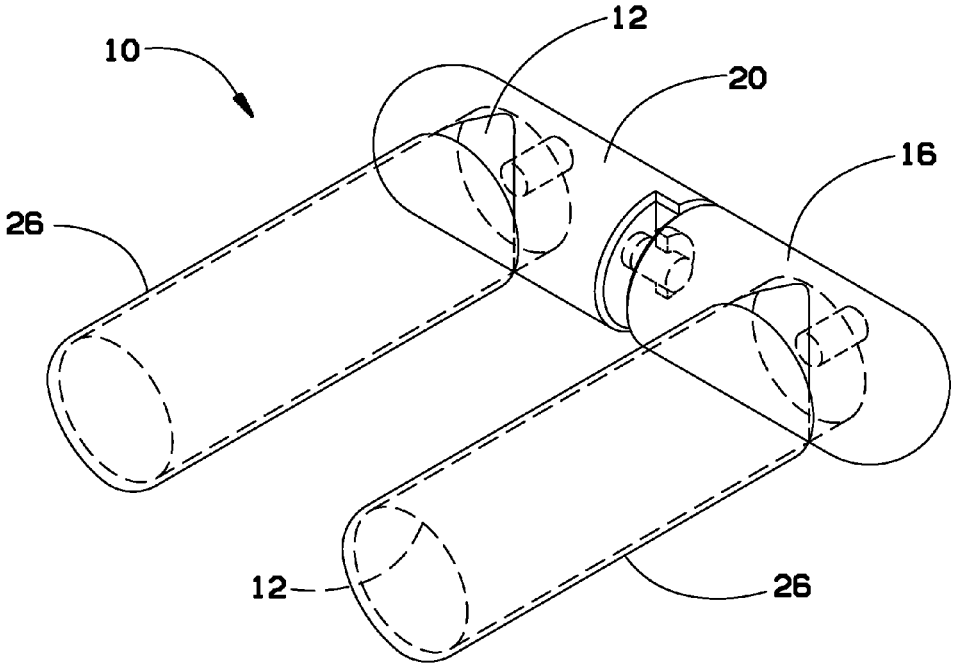
FIG. 1 shows a perspective view of an exemplary embodiment of the present invention.
Figure 2A:
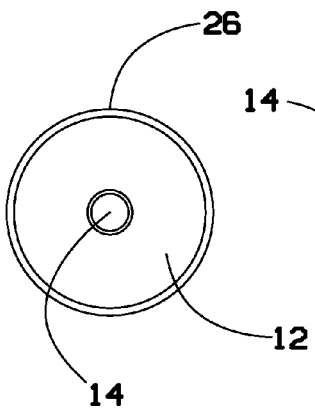
FIG. 2 shows end (2A) and side (2B) views of an exemplary embodiment of the handle of an exemplary embodiment of the present invention.
Figure 2B:
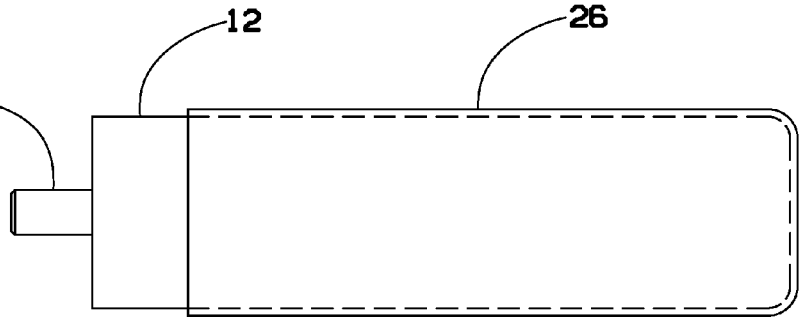
Figure 3A:
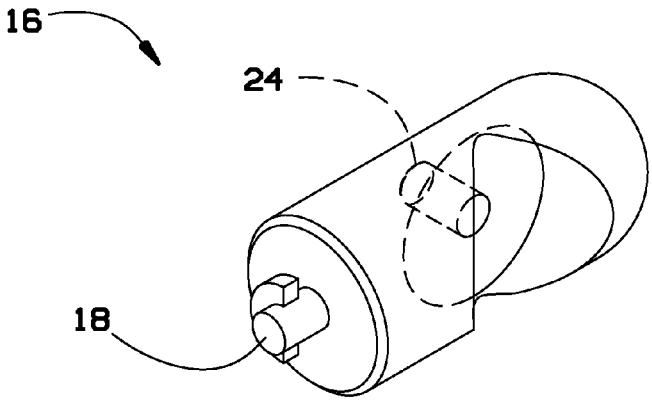
FIG. 3 A-D show views of an exemplary embodiment of the male manufactured head according to the present invention.
Figure 3B:
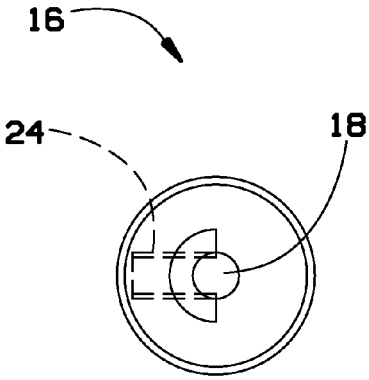
Figure 3C:
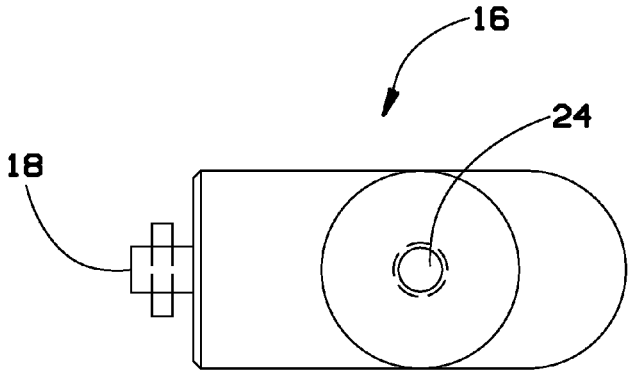
Figure 3D:
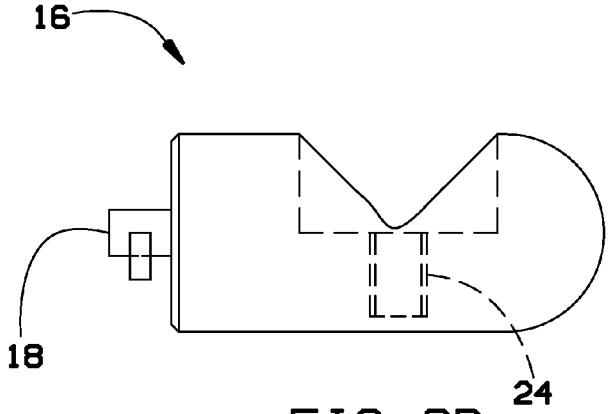
Figure 4A:
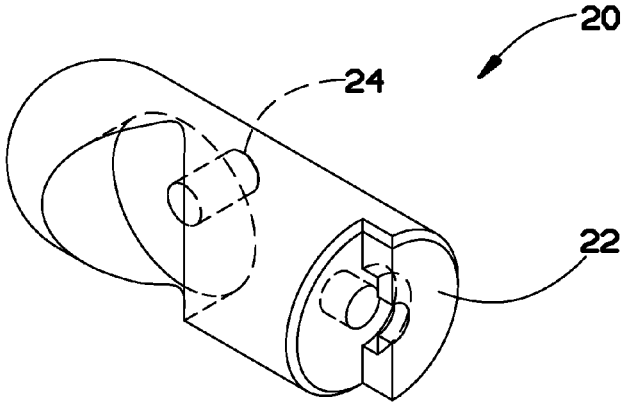
FIG. 4 A-D show views of an exemplary embodiment of the female manufactured head according to the present invention.
Figure 4B:
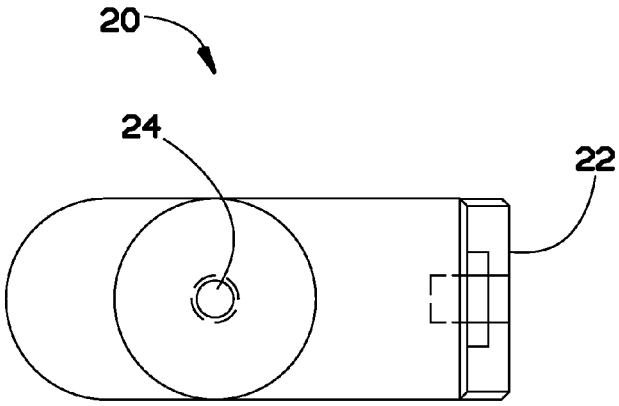
Figure 4C:
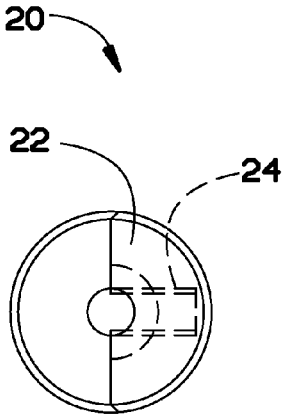
Figure 4D:
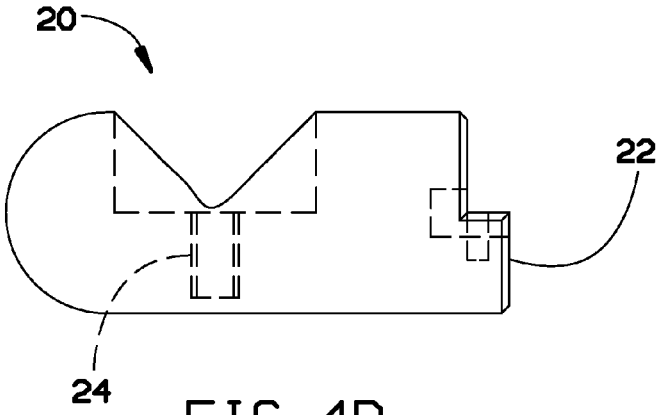

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a training device and method to improve a user's swing in any sport that involves swinging a device such as a club, bat, racket, and the like. Embodiments of the device can also be used as a general exercise device.

An exemplary embodiment of the device, which may be called "Ye Old Swing Trainer", allows all players to feel how the golf club feels when swung correctly, giving the player confidence in their ability to swing the golf club correctly, while at the same time improving the individual's overall physical fitness, and increasing their enjoyment of the game.

The device does not require a left or right handed model as it can be used by all players. The swing trainer can be used indoors and in small spaces. It will allow players who live in cold climates to keep their swing grooved year round.

The swing trainer teaches inside-to-inside swing, teaches keeping the club square through out the golf swing, teaches the player to keep body and arms working together, promotes balance through the swing, teaches good rhythm and tempo, and by feel teaches the player to let the club fall into place on the downswing. The device can come with sets of exercises specifically designed to be incorporated with the swing trainer leading to overall physical fitness, and a lower golf handicap.

In alternative embodiments the device can be used by any athlete who uses a swing in their sport such as, but not limited to, tennis, hockey, and baseball.

Referring now to FIG. 1-4, an exemplary embodiment of the swing trainer (10) comprises three components. Two handles (12) are supplied to be held in the left and right hands. The handles (12) for the left and right hands can be the same shape, size and weight. In an exemplary embodiment the handles (12) are cylinders 6.5 inches long, 5 inches in circumference, and weigh 52 ounces each. The handles (12) can optionally have grips (26) made from, for example, rubber. The handles (12) can be made from steel, and for players in cold and very hot climates the grips (26) add improved grip and comfort to the device (10). In an exemplary embodiment the grips (26) weigh 4 ounces each. The handles (12) can be screwed into a male manufactured head (16) and female manufactured head (20) each manufactured head being of about the same size and weight. In an exemplary embodiment the male manufactured head (16) is 3.5 inches long, 5 inches in circumference, and weighs 17.5 ounces. In an exemplary embodiment the female manufactured head (20) is 4 inches long, 5 inches in circumference, and weighs 18.5 ounces. The handles (12) can have a threaded post (14), and the manufactured heads (16, 20) can have a threaded receptor (24). At the end of each head (16, 20) is machined a connector that can be releasably locked together with a simple male (18) and female (22) type locking device. In an exemplary embodiment the weight of the heads is 36 ounces, the handles 104 ounces, and the grips 8 ounces for a total weight of 148 ounces for the device (10).

The swing trainer can be a multipurpose training tool for improving individual physical fitness. Exercises are combined with the trainer to be a multi-purpose trainer. The user will improve their golf game while at the same time exercising, gaining strength and flexibility.

Figure 5:
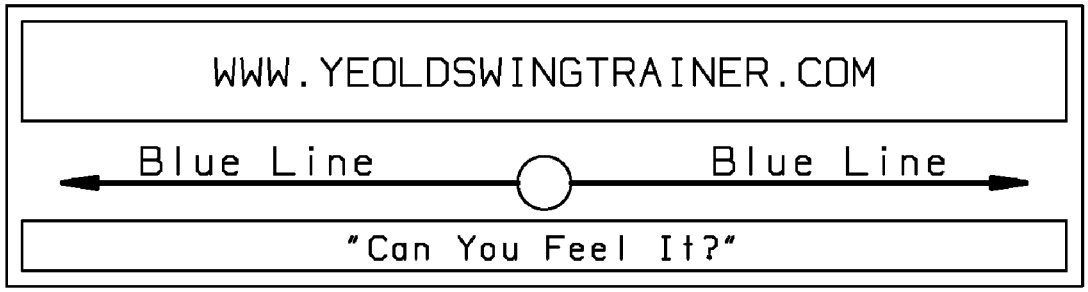
FIG. 5 shows an exemplary embodiment of a training mat according to an embodiment of the present invention.

The swing trainer can come with a training mat (FIG. 5). Six exemplary exercises are designed to be used with a training mat. Instructions for the exercises can be provided. The visual training mat can be used indoors or outdoors and promotes correct alignment, another critical component of the game. The user feels the swing and gets a visual view at the same time. Exercise 1, the curl, is performed with both hands like a weightlifting curl and allows one to see and feel one's weight forward and on the balls of one's feet and, used with the visual training mat, one can see if one is standing too far or too close to the ball at address. Whether one is reaching too far or jamming oneself inside, it is essential to make sure that one's stance begins with one's arms hanging freely down while gripping the club, and the swing trainer makes one do this step right by feel and the weight distribution design of the device. Exercise 2, the butterfly, is performed by releasing the left and right manufactured heads and swinging one's arms upward to the sides while holding one of the heads in each hand. Exercise 3, the 360 degree turn, is performed by releasing the left and right manufactured heads and by pivoting at the waist while holding one of the heads in each hand. This exercise helps to prevent swaying instead of rotating during one's backswing. Exercise 4, the chip, is basically a mini-swing. Exercise 5, the full swing, gives the user the feel of the modern golf swing as if one is swinging the club and rotating one's body. Exercise 6, the putt, is executed like a pendulum swing.

The trainer should be made to specifications to work, as it is based on specific weights. The handles were designed based on a certain circumference and length, each individual head was designed to be a specific weight. When the head and handles are combined they make the swing trainer. Seven prototypes were tested and manufactured before settling on the final product. If the weight is changed in any part of the assembly, the head or handle, when the device is rebalanced it changes the configuration of the final trainer.

It should be understood, of course, that the foregoing relates to exemplary embodiments of the invention and that modifications may be made without departing from the spirit and scope of the invention as set forth in the following claims.

I claim:

1. A swing training device comprising:

two handles, each handle with a threaded post;

a male manufactured head having a first end and a second end, the first end having a male locking device and the second end having a threaded receptacle for the threaded post, the male locking device including:

a cylinder having a cylinder end extending from the first end of the male manufactured head; and a semicircular flange about the cylinder and spaced a distance inwardly from the cylinder end towards the first end of the male manufactured head; and a female manufactured head having a first end and a second end, the first end of the female manufactured head having a female locking device and the second end of the female manufactured head having a threaded receptacle for the threaded post; the female locking device including:

a cylindrical recess in the first end of the female manufactured head sized to snugly receive the cylinder; and a semicircular recess in the first end of the female manufactured head spaced a distance away from the cylindrical recess and sized to rotationally receive the semicircular flange when the cylinder is fully inserted into the cylindrical recess;

wherein one handle is connected to each manufactured head by screwing the threaded post into the threaded receptacle; and wherein the male locking device is releasably connected to the female locking device;

thereby forming the swing training device.

2. The swing training device of claim 1 wherein the handles further comprise grips.

3. The swing training device of claim 2 wherein;

each handle is a cylinder 6.5 inches long, 5 inches in circumference, and weighing 52 ounces;

the male manufactured head is 3.5 inches long, 5 inches in circumference, and weighs 17.5 ounces;

the female manufactured head is 4 inches long, 5 inches in circumference, and weighs 18.5 ounces; and the grips are rubber and weigh 4 ounces each.

4. A method of general fitness training comprising: according the swing training device of claim 1; and providing instructions for exercises using the swing training device;

whereby a user can perform general fitness training.

5. The method of claim 4 wherein the handles of the swing training device further comprise grips.

6. The method of claim 5 wherein the grips are rubber.

7. The swing training device of claim 1, wherein the handles extend in a parallel orientation from the male manufactured head and the female manufactured head when the male locking device is engaged with the female locking device.

8. The swing training device of claim 7, wherein the male locking device is engaged with the female locking device by orienting the handles to extend in opposing directions from the male manufactured head and the female manufactured head when the heads are linearly aligned, inserting the cylinder into the cylindrical recess, and rotating the handles to extend in the same direction from the male manufactured head and the female manufactured head, wherein the semicircular flange is snugly and rotationally received by the semicircular recess.

* * * * *